US006237822B1

(12) United States Patent
Vidal

(10) Patent No.: US 6,237,822 B1
(45) Date of Patent: May 29, 2001

(54) HAND TOOL RETAINING DEVICE

(76) Inventor: Michael Vidal, 1831 N. Pass Ave., Burbank, CA (US) 91505

( * ) Notice: Subject to any disclaimer, the term of this patent is extended or adjusted under 35 U.S.C. 154(b) by 0 days.

(21) Appl. No.: 09/417,529

(22) Filed: Oct. 13, 1999

(51) Int. Cl.[7] ..... A45F 5/14

(52) U.S. Cl. ..... 224/242; 224/234; 224/678; 224/247; 224/269; 224/904

(58) Field of Search ..... 224/904, 605, 224/649, 650, 678, 234, 242, 269, 247

(56) References Cited

U.S. PATENT DOCUMENTS

| | | | | |
|---|---|---|---|---|
| 2,956,715 | * | 10/1960 | Henderson | 224/904 |
| 3,100,590 | | 8/1963 | Bohlsen . | |
| 3,130,883 | * | 4/1964 | MacKool | 224/904 |
| 3,212,688 | | 10/1965 | Lane . | |
| 3,294,298 | | 12/1966 | Danielson . | |
| 3,318,499 | | 5/1967 | Kallio . | |
| 3,384,277 | * | 5/1968 | Hodelka | 224/904 |
| 3,599,847 | | 8/1971 | Danielson . | |
| 4,638,530 | | 1/1987 | Perry . | |
| 4,790,461 | | 12/1988 | Stover . | |
| 4,830,247 | * | 5/1989 | Banks | 224/904 |
| 4,936,499 | | 6/1990 | Gulley . | |
| 4,951,857 | * | 8/1990 | Carr | 224/230 |
| 5,232,136 | * | 8/1993 | Unger | 224/904 |
| 5,248,072 | * | 9/1993 | Jones | 224/247 |
| 5,547,115 | | 8/1996 | Ambrosius et al. . | |
| 5,582,338 | | 12/1996 | Tamura . | |
| 5,605,263 | * | 2/1997 | Pursley et al. | 224/248 |
| 5,727,290 | * | 3/1998 | Gilbert et al. | 224/269 |
| 5,826,762 | | 10/1998 | Dellinger . | |
| 5,833,095 | | 11/1998 | Russell et al. . | |
| 5,915,610 | * | 6/1999 | Russell | 224/904 |
| 5,941,434 | * | 8/1999 | Green | 224/250 |

FOREIGN PATENT DOCUMENTS

| | | |
|---|---|---|
| 2635804 | 9/1988 | (FR) . |

* cited by examiner

*Primary Examiner*—Stephen P. Garbe
(74) *Attorney, Agent, or Firm*—Sheldon & Mak; Denton L. Anderson

(57) ABSTRACT

A hand tool retaining device has an elongate backing element, a base element and an elongate guide element having an elongate slot disposed along the backing element. The guide element is disposed along the backing element such that a hand tool can be disposed against the backing element with the head of the hand tool resting upon the base element, with the handle of the hand tool disposed parallel to and contiguous with the backing element and the with head of the hand tool disposed within the slot. An optional retaining clip can be used to removably retain the tool within the retaining device.

28 Claims, 6 Drawing Sheets

30
78
68
40
74
16
52
42
80
58
34
50
12
38
36
10
18a
48
18
76
66
32
14
88
90
84
77
72
6
42
52
60
38
86

78
80
18a
88
84
90
12
86
14

HAND TOOL RETAINING DEVICE

FIELD OF THE INVENTION

This invention is directed generally to retaining devices for retaining hand tools and, more specifically, to devices for retaining hand tools such as hammers and hatchets.

BACKGROUND OF THE INVENTION

Devices for retaining hand tools, such as hammers and hatchets, have been known for a long time. However, all previously-known hand tool retaining devices are awkward to use for several reasons. First of all, the prior art retaining devices are generally designed to hang downwardly from the worker's belt, so that tools retained within the retaining devices dangle at the user's side. These and similar designs frequently result in the tools retained in such prior art devices obstructing the worker's freedom of movement. Secondly, many prior art retaining devices do not securely retain the hand tool within the retaining device. Use of such devices presents a danger that the hand tool may come loose from the retaining device and fall to the ground. (This presents a very serious problem where work is performed at elevated locations.) Thirdly, those prior art retaining devices which actually do firmly retain the hand tool are generally awkward to use. In most cases, the user must use both hands to engage and disengage the hand tool from the retaining device.

Accordingly, there is a need for a hand tool retaining device which avoids the aforementioned problems with the prior art in an inexpensive and efficient manner.

SUMMARY

The invention satisfies this need. The invention is a hand tool retaining device for retaining a hand tool having a handle and a head, the head having a base portion, a neck portion and a bulbous portion, the hand tool retaining device comprising (a) an elongate backing element having a top end and a bottom end, (b) a base element disposed proximate to the bottom end of the backing element, and (c) an elongate guide element disposed along the backing element, the guide element having a first exterior side, an opposed second exterior side and an elongate slot which connects the first exterior side with the second exterior side, the slot having a top end, a bottom end, a width between about ½ inch and about 2 inches and an opening proximate to the top end of the slot for placing the head of a hand tool within the slot, the guide element being disposed along the backing element such that a hand tool can be disposed against the backing element with the head of the hand tool resting upon the base element, with the handle of the hand tool disposed parallel to and contiguous with the backing element, with the neck portion of the head of the hand tool disposed within the elongate slot of the guide element, with the base portion of the head disposed outside of the elongate slot along the first exterior side of the guide element and with the bulbous portion of the head disposed outside of the elongate slot along the second exterior side of the guide element.

In a typical embodiment, the elongate guide element is provided by an elongate loop, and the retaining means is provided by a metal clip.

Preferably, the hand tool retaining device further comprises attachment means for attaching the retaining device on the back of the user, so that the retaining device does not impede the user's freedom of movement.

DRAWINGS

These features, aspects and advantages of the present invention will become better understood with regard to the following description, appended claims and accompanying figures where:

Figures 2A, 2B:
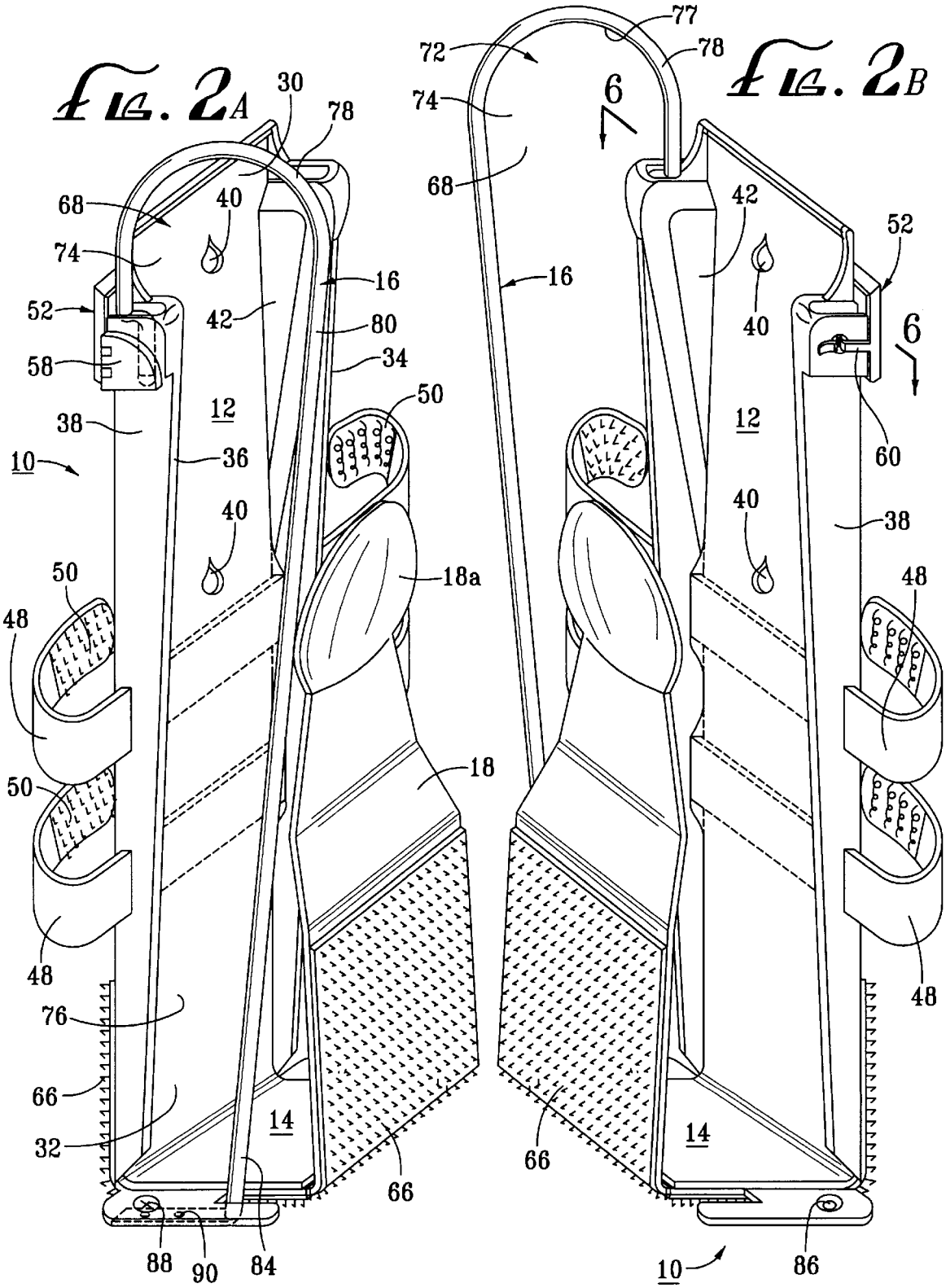
FIG. 2A is a perspective view of a hand tool retaining device having features of the invention.
FIG. 2B is a perspective view of the hand tool retaining device illustrated in FIG. 2A showing the opposite side of the retaining device.
Figure 2C:
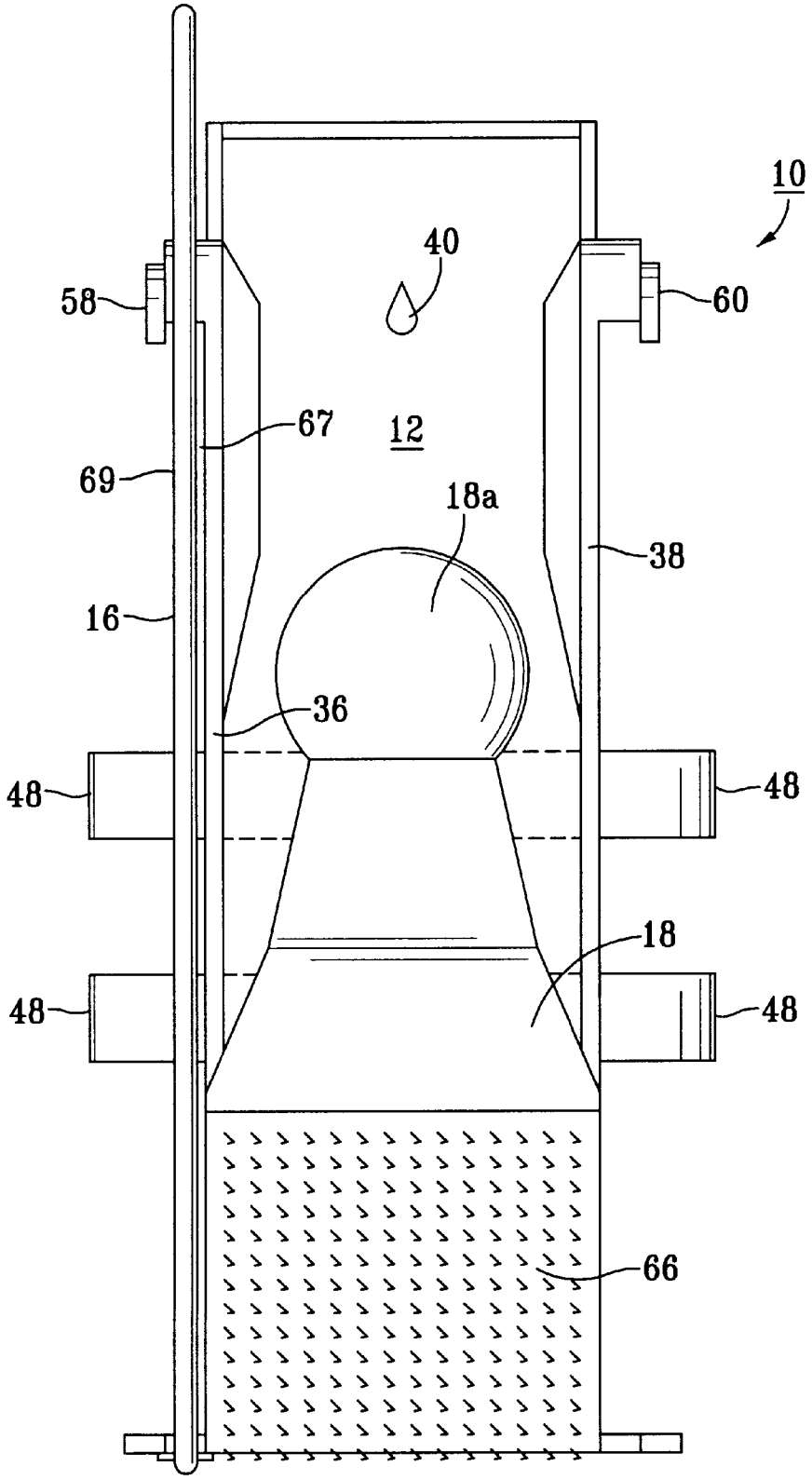
FIG. 2C is a front view of the hand tool retaining device illustrated in FIG. 2A.
Figure 3:
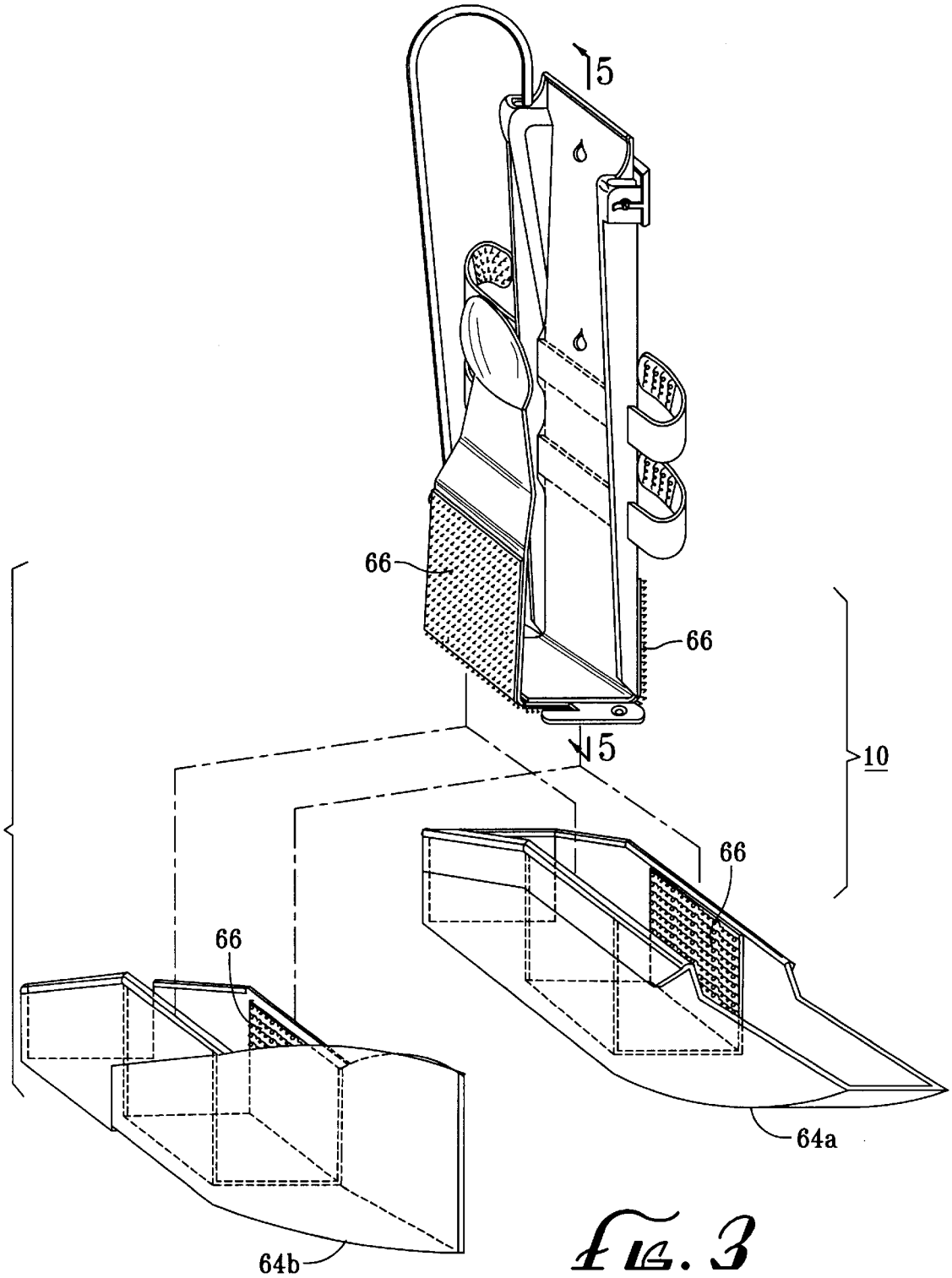
FIG. 3 is a perspective view of the hand tool retaining device illustrated in FIG. 2A further illustrating the attachment and deattachment of head covers used in the invention.
Figure 6A:
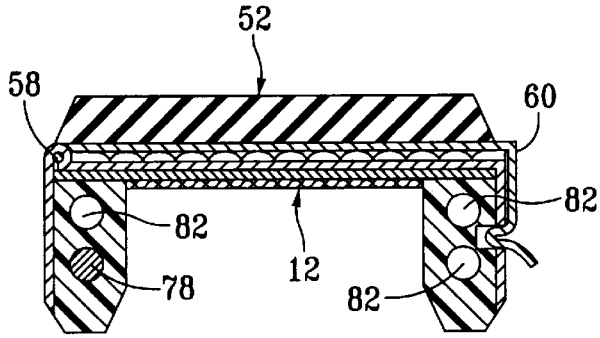
Figure 6B:
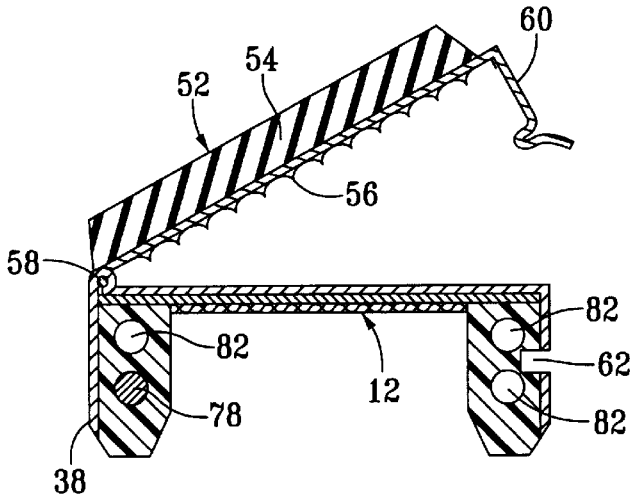

FIG. 6A is a cross-sectional top view of the hand tool retaining device illustrated in FIG. 2B taken along line 6—6, showing a backing element clip useable in the invention, the backing element clip being shown in the closed position; and FIG. 6B is a cross-sectional top view of the hand tool retaining device illustrated in FIG. 2B taken along lines 6—6, showing a backing element clip useable in the invention, the backing element clip being shown in the open position.

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a hand tool retaining device 10 comprising an elongate backing element 12, a base element 14, an elongate guide element 16, and hand tool retaining means 18. The invention is ideal for retaining a hand tool 20 such as a hammer 0*a* or a hatchet having a handle 22 and a head 24, wherein the head 24 comprises a base portion 25 and a bulbous poll portion 26 extending from a more narrow neck portion 28.

The elongate backing element 12 is typically a plate having a length between about 6 inches and about 24 inches and a width between about 1 inch and about 4 inches. The backing element 12 has a top end 30, a bottom end 32, a right side 34 and a left side 36. The backing element 12 can be made from a durable plastic or from a metal, such as aluminum or sheet steel having a thickness between about 1/16 inch and about 3/16 inch.

The backing element 12 can be a relatively simple flat structure. Alternatively, as illustrated in the drawings, the backing element 12 can comprise reveal tracks 38 which assist in securing the handle 22 of a hand tool 20 within the retaining device 10. The backing element 12 can also comprise one or more backing element apertures 40 to allow the retaining device to be conveniently stored in an upright position on a nail or hook extending from a vertical wall surface.

Finally, the backing element 12 can comprise one or more handle clip 42 for removably attaching and deattaching the handle 22 of a hand tool 20 to the retaining device 10.

Preferably, the backing element 12 comprises means for removably attaching the device to an elongate strap having a width between about ½ inch and about 4 inches. In the preferred embodiment illustrated in the drawings, such means are capable of removably attaching the hand tool device 10 to a substantially vertical strap 44, such as to the suspenders 44*a* of a user 46. This important feature allows the hand tool retaining device 10 to be conveniently retained on the back of the user 46, out of the way of the user 46 during the course of the user's work activities.

As illustrated in FIGS. 2A and 2B, such means for removably attaching the retaining device 10 to an elongate strap 44 can include a pair of attachment straps 48 which are closed using hook and loop fasteners 50. Such means can further include a backing element clip 52 to allow the retaining device 10 to be easily adjusted upwards and downwards along the substantially vertical strap 44 (such as the rear of the worker's suspenders 44*a*).

As illustrated in FIGS. 6A and 6B, the backing element clip 52 can comprise a base portion 54 having a non-skid inside surface 56 attached to the backing element 12. An open/close mechanism 60 is attachable to the backing element clip 12 with a hinge 58 and is sized and dimensioned to removably mate with an open/close slot 62 in the backing element 12.

The base element 14 is disposed proximate to the bottom end 32 of the backing element 12. The base element 14 is typically disposed at right angles to the backing element 12 to provide a generally horizontal "shelf" upon which a hand tool 20 can be rested. The base element 14 can be formed integrally with the backing element 12 or it can be a separately manufactured part which is later attached to the backing element 12. The base element 14 typically has a width which generally matches the width of the backing element 12. The base element 14 protrudes at right angles to the backing element 12 a distance sufficient to support a hand tool. Preferably, however, the base element 14 does not protrude away from the backing element 12 a distance any further than necessary to retain the hand tool 20. In a typical embodiment, the base element 14 protrudes away from the backing element 12 a distance between about 1 inch and about 3 inches. Like the backing element 12, the base element 14 is typically made from a durable formed plastic, other appropriate plastic, or a metal, such as aluminum or sheet steel having a thickness between about 1/16 inch and about 3/16 inch.

The base element 14 can further comprise a hand tool head cover 64 for substantially enclosing the head 24 of a hand tool 20 retained within the retaining device 10. Such a hand tool head cover 64 is illustrated in FIGS. 1A, 1B, 1C and 3. The head cover 64 provides additional support to a hand tool 20 disposed within the retaining device 10 and further prevents the hand tool 20 from slipping out of the retaining device 10 in a left or right lateral direction. (Where the hand tool is a hatchet, the head cover 64 further protects the user and others from being cut by the blade of the hatchet.) Preferably, the head cover 64 is sized and dimensioned to closely conform to the head 24 of the hand tool 20 to be retained within the retaining device 10. For example, where the hand tool 20 is a hammer, a hammer-shaped head cover 64*a* is provided, and, where the hand tool 20 is a hatchet, a hatchet-shaped head cover 64*b* is provided. In the preferred embodiment illustrated in the drawings, the head cover 64 can be made from a leather. Plastics, nylon cloth and canvas can also be used. The head cover 64 is preferably removably attachable to the backing device 12, such as by snaps, hooks, bolts and nuts, etc. The inventor has found that the head cover 64 can most conveniently be attached to the backing element 12 using hook and loop fasteners 66. Hook and loop fasteners 66 have sufficient strength to rigidly retain the head cover 64 on the backing element 12, while allowing the user to quickly and easily replace the head cover 64 with a different sized and/or dimensioned head cover 64. Preferably, the head cover 64 is readily removably attachable and deattachable from the backing element 12, most preferably without the use of tools.

The elongate guide element 16 is disposed along the backing element 12, typically disposed at right angles to the backing element 12, such that the guide element 16 protrudes away from the backing element 12 as illustrated in the drawings.

The guide element 16 has a first exterior side 67, an opposed second exterior side 69 and an elongate slot 68. The slot 68 has a width capable of accepting the neck portion 28 of a hand tool 20. Typically, this width is between about ½ inch and about 2 inches. The elongate slot 68 also has an opening 72 proximate to the top end 74 of the slot 68 for protruding the head 24 of a hand tool 20 within the slot 68. In one embodiment, the elongate slot 68 linearly increases in width from the bottom end 76 of the slot 68 to the top end 74 of the slot 68 until the width at the top end 74 of the slot 68 is sufficiently wide to provide the opening 72 for allowing the protruding of the head 24 through the slot 68. In a typical such embodiment, the increase in width from the bottom end 76 of the slot 68 to the top end 74 of the slot 68 is between about ½ inch and about 2 inches.

The top end 74 of the elongate slot 68 constitutes a stop 77 for physically preventing the head 24 of the hand tool 20 from disengaging from the retaining device 10 in an upward, axial direction.

Figure 1C:
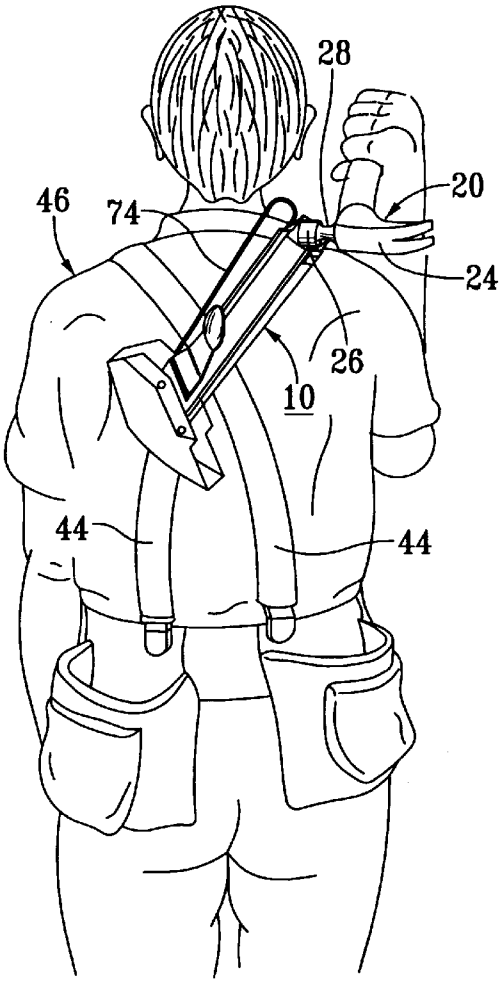
FIG. 1C is a perspective view of the user and hand tool retaining device illustrated in FIG. 1A showing the retaining device after the tool has been removed entirely from the retaining device.
Figure 1B:
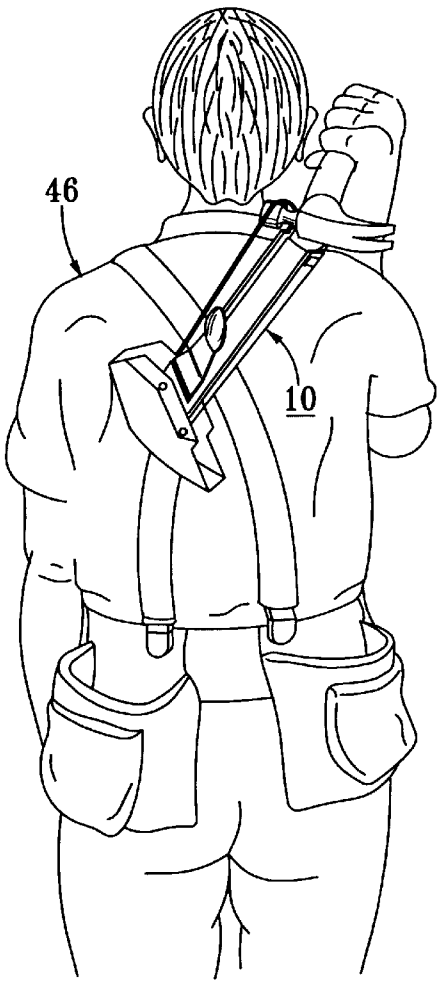
FIG. 1B is a perspective view of the user and hand tool retaining device illustrated in FIG. 1A, showing how the hand tool can be removed from the retaining device.
Figure 1A:
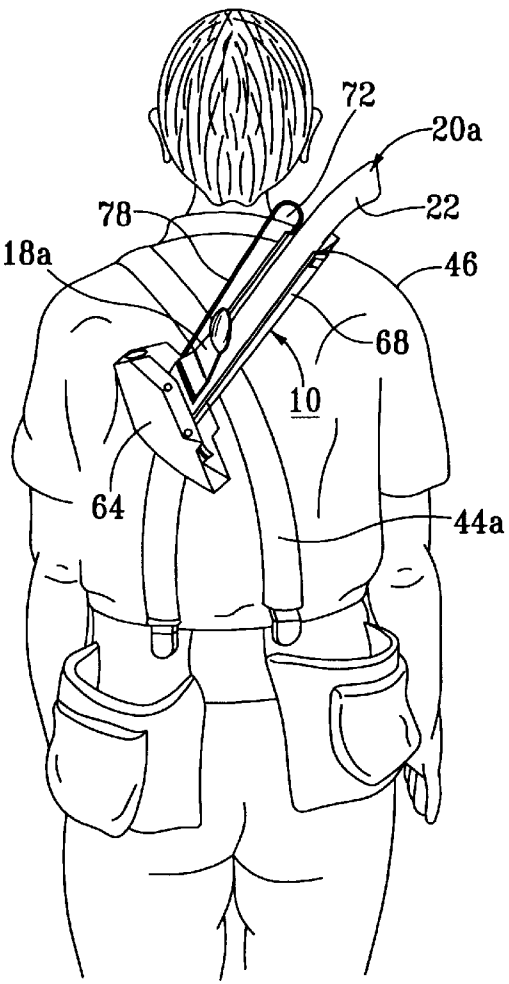
FIG. 1A is a perspective view of a user carrying a hand tool in a hand tool retaining device having features of the invention.

As illustrated in FIG. 1A, the guide element 16 is disposed along the backing element 12, such that a hand tool 20 can be disposed against the backing element 12 with the head 24 of the hand tool 20 resting upon the base element 14 and with the handle 22 of the hand tool 20 disposed parallel to and contiguous with the backing element 12, with the neck portion disposed within the elongate slot 68, with the base portion 25 disposed outside the elongate slot 68 along the first exterior side 67 of the guide element and with the bulbous portion 26 disposed outside of the elongate slot 68 along the second exterior side 69 of the guide element 16.

The elongate guide element 16 can be a thin strip of material having a "cut-out" which provides the slot 68. Alternatively, as illustrated in the drawings, the elongate guide element 16 can be conveniently provided by an elongate loop 78 made from steel wire or tubing having, for example, a thickness between about 3/16 inch and about ¼ inch. The width of the slot 68 at the top end 74 of the slot 68 provides the opening 72 to allow the head 24 of a hand tool 20 to be protruded into and out of the top end 74 of the slot 68 as illustrated in FIGS. 1B and 1C. Conversely, the width of the slot 68 at the bottom end 76 of the slot 68 is sufficiently narrow to prevent the head 24 of the hand tool 20 from being removed from the bottom end 76 of the slot 68. The elongate slot 68 and the elongate loop 78 can have a larger width at the top end 74 of the slot 68 than the width of the slot 68 at the bottom end 76 of the slot 68.

Figure 4:
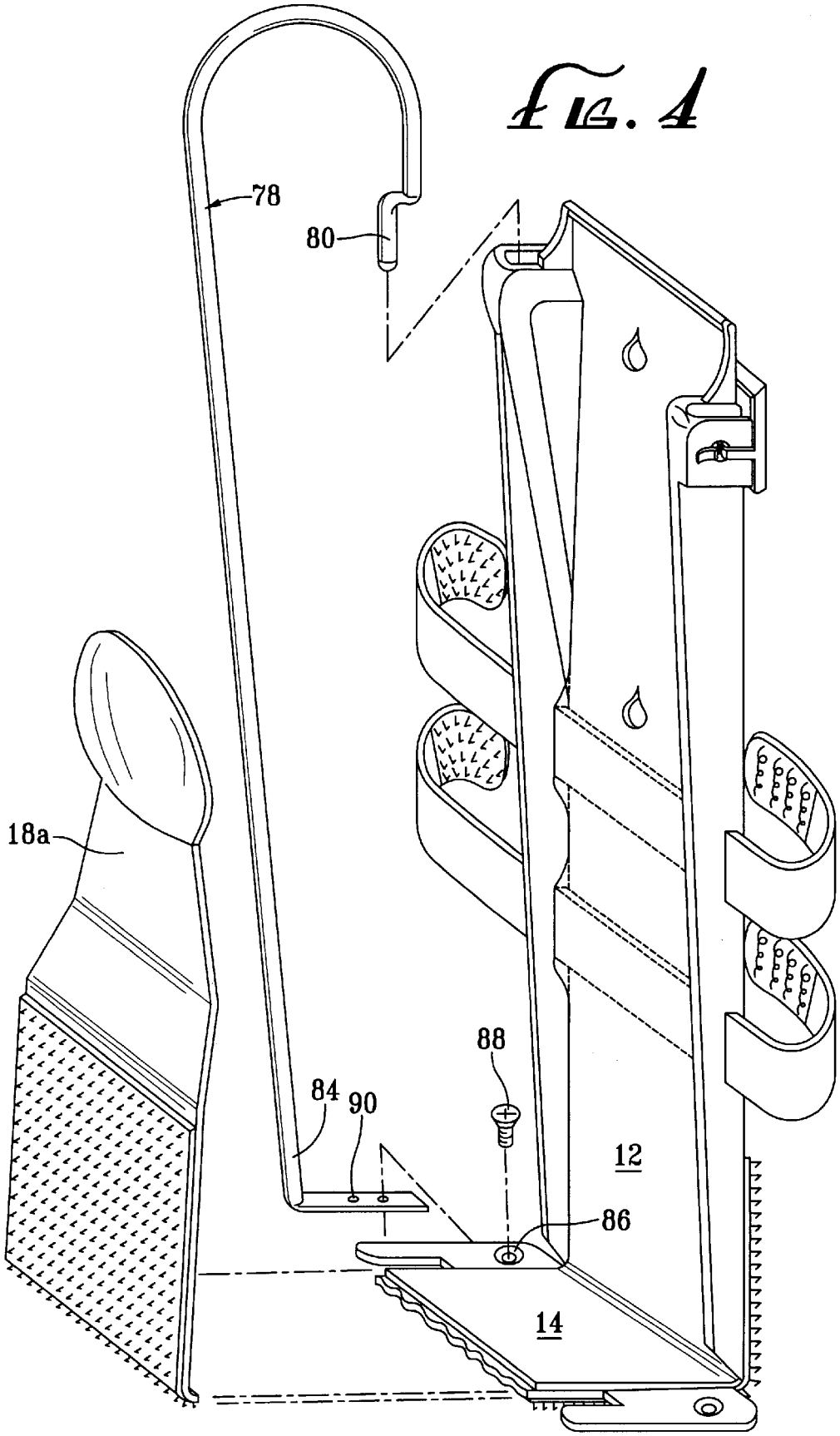
FIG. 4 is an exploded view of the hand tool retaining device illustrated in FIG. 2A.
Figure 5:
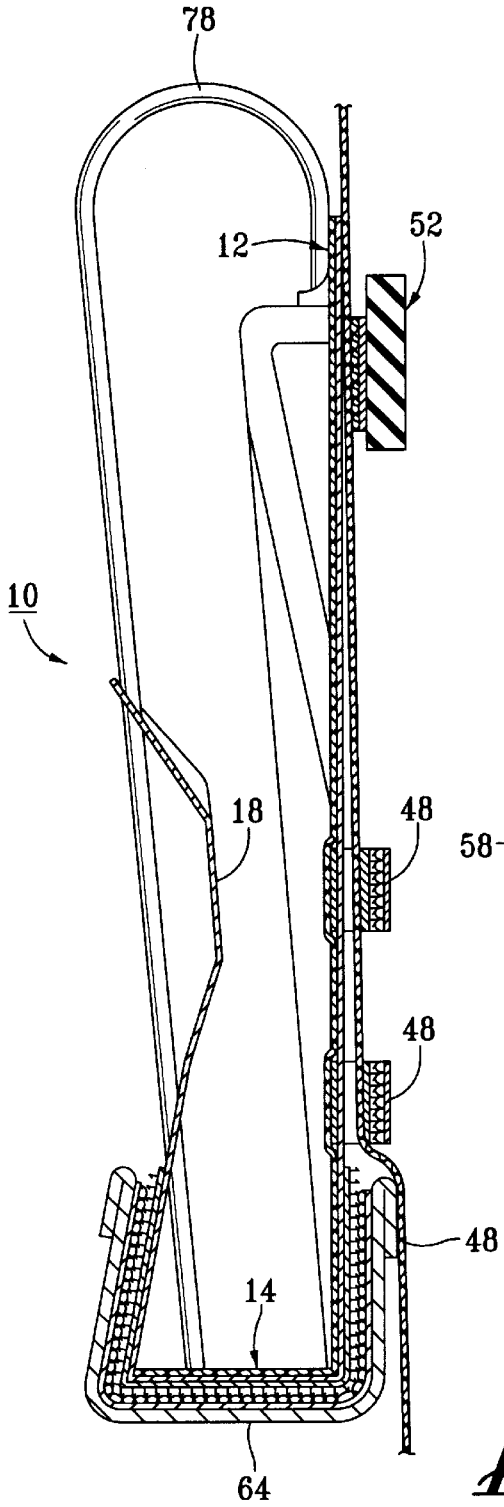
FIG. 5 is a cross-sectional side view of the hand tool retaining device illustrated in FIG. 3 taken along line 5—5.

As illustrated in FIGS. 4 and 6, the upper portion 80 of the elongate loop 78 is attached to the backing element 12 in a backing element bore 82 disposed within the handle clip 42. The lower portion 84 of the loop 78 is attached to the base element 14 at a base element bore 86 by insertion of a lower end loop screw 88 through a lower end loop aperture 90. Preferably, as illustrated in FIGS. 4, 6A and 6B, the backing element 12 can comprise a plurality of backing element bores 82 on at least one side of the backing element 12 and the lower portion 84 of the loop 78 can comprise a plurality of lower end loop apertures 90 so as to allow the effective width of the elongate slot 68 to be adjustable. This allows the retaining device 10 to accommodate hand tools 20 having differing widths of neck portions 28 and poll portions 26.

Another important feature of the embodiments illustrated in the drawings is that the loop 78 can be installed on either the right side 34 of the backing element 12 or the left side 36 of the backing element 12. This feature allows use of the retaining device 10 by both left-handed workers and by right-handed workers. As illustrated in FIGS. 4, 6A and 6B, the backing element 12 has one or more backing element bores 82 on both the right side 34 and the left side 36 of the backing element 12. Similarly, as illustrated in FIG. 4, the base element 14 has base element bores 86 located at both the left side and the right side of the base element 14. Accordingly, it is an easy task for a worker to move the elongate loop 78 from the right side 34 of the backing element 12 to the left side 36 of the backing element 12 by merely removing the lower end loop screw 88 from a right base element bore 86 on the right side of the base element 14, removing the loop 78 from the backing element bore 82 on the right side 34 of the backing element 12, reinserting the loop 78 into a backing element bore 82 on the left side 36 of the backing element 12 and reattaching the lower portion 78 of the loop 78 to the left side of the base element 14 by reinserting the lower end loop screw 88 through the bottom end loop aperture 90 and into the base element bore 86 on the left side of the base element 14.

In the embodiments illustrated in the drawings, the hand tool reining means 18 is provided by a head clip 18*a* for removably retaining the head 24 of a hand tool 20 within the retaining device 10. Typically, the head clip 18*a* is made from a plastic or from a resilient metal, such as steel. The head clip 18*a* can be made integral with the base element 14 or can be manufactured separately and attached to the base element 14 or to the backing element 12. The head clip 18*a* has sufficient rigidity to securely retain a hand tool 20 within the retaining device 10, but is sufficiently resilient to allow for the insertion and removal of the hand tool 20 into and out of the retaining device 12 without undue exertion.

In operation, the embodiment of the retaining device 10 can be used in the following manner. A user 46 of the retaining device 10 first inspects the orientation of the loop 78 on the backing element 12. If the user 46 is right-handed, the loop 78 should be disposed on the left side 36 of the backing element 12. If the loop 78 is initially disposed on the right side 34 of the backing element 12, the user 46 removes the lower end loop screw 88 from the lower end loop aperture 90 on the right side of the base element 14, removes the loop 78 from the backing element bore 82 on the right side 34 of the backing element 12, reinserts the loop 78 into a backing element bore 82 located on the left side 36 of the backing element 12 and then secures the lower portion of the loop 84 to the base element 14 by reinserting the lower end loop screw 88 into a lower end loop aperture 90 located on the left side of the base element 14.

Once the loop 78 is properly oriented with respect to the right side 34 and left side 36 of the backing element 12, the width of the slot 68 in the loop 78 is inspected for proper dimensions. For smaller hand tools 20, such as hammers 20*a* having a neck portion 28 thickness of between about ½ inch and about ⅞ inch and a poll portion 26 thickness between about 1 inch and about 1.5 inches, the width of the slot 68 in the lower portion 84 of the loop 78 should be between about 1 inch and about 1 inch and the width of the slot 68 in the upper portion 80 of the loop 78 should about 2 inches. Alternatively, for large hand tools 20, such as a hammer 20*a* having a neck portion 28 with a width of between about ⅞ inch and about 1.25 inches, and a poll portion 26 having a width between about 1.5 inches and about 1.75 inches, the width of the slot 68 in the lower portion 84 of the loop 78 should be between about ⅞ inch and about 1.25 inches, and the width of the slot 68 in the upper portion 80 of the loop 78 should be about 2 inches.

After having adjusted the width of the slot 68 in the loop 78, the user 46 attaches a properly sized and dimensioned head cover 64 to the backing device 12 using the hook and loop fasteners 66.

Next, the user 46 attaches the retaining device 10 to the back of the user's suspenders 44*a* by wrapping the attachment straps 48 around the suspenders 44*a* and closing the attachment straps 48 using the hook and loop fasteners 50. Thereafter, the height of the retaining device 10 on the back of the suspenders 44*a* is adjusted and the retaining device 10 firmly attached to the suspenders 44*a* by closing the open/close mechanism 60 of the backing element clip 52 so that the non-skid portion 56 of the backing element clip 52 grips the suspenders 44*a*. Thereafter, the open/close mechanism 60 is secured by insertion into the open/close slot 62 in the backing element 12.

After attaching the retaining device 10 to the suspenders 44*a* , the user 46 places the suspenders 44*a* on his or her person. This conveniently locates the retaining device 10 on the back of the user 46. The user 46 then places the hand tool 20 into the retaining device 10 in the following manner (as illustrated in FIGS. 1B and 1C). First, while holding the handle 22 of the hand tool 20, the user 46 rests the hand tool 20 on his or her shoulder. Next, the user 46 locates the top of the loop 78 with the poll portion 26 of the hand tool 20. The user 46 then slides the poll portion 26 of the hand tool 20 horizontally until the poll portion 26 can be inserted into the opening 72 in the slot 68. Next, with the poll portion 26 of the hand tool 20 protruded through the slot 68, and with the neck portion 28 of the hand tool 20 disposed within the slot 68, the user 46 slides the head 24 of the hand tool downwards until the head contacts the head clip 18*a*. Next, the user 46 continues to push downwardly on the hand tool 20 until the head 24 travels past the head clip 18*a* to the base element 12 and nests within the head cover 64. Finally, the user presses the handle 22 of the hand tool 20 against the backing element 12 until the handle 22 is engaged by the handle clips 42 in the backing element 12. The hand tool 20 is now firmly retained within the retaining device 10. Because the hand tool 20 and retaining device 10 is disposed on the back of the user 46, the user 46 has maximum freedom of movement to conduct his or her work activities.

During the course of the user's activities, when the hand tool 20 is required, the user 46 removes the hand tool 20 from the retaining device 10 in the following manner. First, the user 46 grasps the handle 22 of the hand tool 20 and disengages the handle 22 from the handle clips 42. Next, the user 46 draws the head 24 of the hand tool 20 upwards so that the head 24 is drawn out of the head cover 64. Thereafter, the user 46 continues to draw the head 24 of the hand tool 20 upwards until the head 24 clears the head clip 18*a*. (Note that, throughout the travel of the hand tool 20 along the backing element 12, the head 24 of the hand tool 20 is firmly retained within the slot 68 of the loop 78 because the poll portion 26 of the head 24 is retained by the slot 68 in the loop 78.) After the head 24 of the hand tool 20 is drawn upwards above the head clip 18*a*, the head 20 is drawn further upwards along the backing element 12 until the neck portion 28 contacts the stop 77 at the top of the guide element 16. The use of the stop 77 prevents the user 46 from inadvertently striking himself or herself in the head by withdrawing the hand tool 20 too rapidly from out of the retaining device 10. At this juncture, the user 46 then disengages the hand tool 20 from the loop 78 by drawing the poll portion 26 through the opening 72 in the slot 68. After removal of the hand tool 20 from the retaining device 10, the retaining device 10 remains on the back of the user 46, conveniently out of the way of the user 46, thus maximizing his or her freedom of movement.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A hand tool retaining device for retaining a hand tool having a handle and a head, the head having a base portion, a bulbous portion and a neck portion, the retaining device comprising:

(a) an elongate backing element having a top end and a bottom end;

(b) a base element disposed proximate to the bottom end of the backing element; and (c) an elongate guide element disposed along the backing element, the guide element having a first exterior side, an opposed second exterior side and an elongate slot which connects the first exterior side with the second exterior side, the slot having a top end, a bottom end, a width between about ½ inch and about 2 inches and an opening proximate to the top end of the slot for placing the head of a hand tool within the slot, the guide element being disposed along the backing element such that a hand tool can be disposed against the backing element with the head of the hand tool resting upon the base element, with the handle of the hand tool disposed parallel to and contiguous with the backing element, with the neck portion of the head of the hand tool disposed within the elongate slot of the guide element, with the base portion of the head disposed outside of the elongate slot along the first exterior side of the guide element and with the bulbous portion of the head disposed outside of the elongate slot alone the second exterior side of the guide element.

2. The hand tool retaining device of claim 1 wherein the opening in the guide element is provided by a wide portion in the elongte slot proximate to the upper end of the slot and wherein the elongate slot in the guide element further comprises a narrow portion proximate to the bottom end of the slot, the narrow portion being narrower than the wide portion.

3. The hand tool retaining device of claim 1 wherein the backing element comprises at least one backing element clip capable of removably attaching the hand tool retaining device to an elongate strap having a width between about ½ inch and about 4 inches.

4. The hand tool retaining device of claim 1 wherein the backing element comprises at least one backing element clip capable of removably attaching the hand tool retaining device to a substantially vertical strap having a width between about ½ inch and about 4 inches.

5. The hand tool retaining device of claim 1 further comprising at least one handle clip for removably attaching and deattaching the handle of a hand tool to the hand tool retaining device.

6. The hand tool retaining device of claim 1 further comprising at least one head clip for removably retaining the head of a hand tool to the hand tool retaining device.

7. The hand tool retaining device of claim 1 wherein the base element comprises a head cover removably attached to the elongate backing element by attachment means requiring the use of no tools.

8. The hand tool retaining device of claim 7 wherein the head cover is attached to the backing element by hook and loop attachment.

9. The hand tool retaining device of claim 1 wherein the guide element is an elongate loop.

10. The hand tool retaining device of claim 1 wherein the elongate slot has a width between about ½ inch and about 4 inches.

11. The hand tool retaining device of claim 1 wherein the elongate slot linearly increases in width from the bottom end of the slot to the top end of the slot by a total increase of between about ½ inch and about 1½ inch.

12. The hand tool retaining device of claim 1 wherein the backing element has a left side and a right side and wherein the guide element is removably attached to either the left side or the right side.

13. The hand tool retaining device of claim 12 wherein the backing element has a longitudinal axis and at least one pair of bores disposed on its left and right sides, the bores being disposed in parallel with the longitudinal axis, and wherein the guide element is an elongate loop having at least one end portion disposed within one of the two bores.

14. The hand tool retaining device of claim 1 wherein the width of the elongate slot in the guide element is adjustable.

15. The hand tool retaining device of claim 1 wherein the backing element has at least two backing element bores disposed on the same side of the backing element and wherein the guide element is an elongate loop having at least one end portion disposed within one of the backing element bores.

16. The hand tool retaining device of claim 1 wherein a stop is disposed at the top end of the elongate slot within the guide element.

17. The hand tool retaining device of claim 1 further comprising a hand tool having a handle and a head, the head having a base portion, a bulbous portion and a neck portion, the hand tool being disposed against the backing element of the retaining device with the handle of the hand tool in parallel with and contiguous to the backing element, with the head of the hand tool disposed in contact with the base element, with the neck of the head disposed within the elongate slot in the guide element, with the base portion of the head disposed outside of the elongate slot along the first exterior side of the guide element and with the bulbous portion of the head disposed outside of the elongate slot along the second exterior side of the guide element.

18. A hand tool retaining device for retaining a hand tool having a handle and a head, the head having a base portion, a bulbous portion and a neck portion, the retaining device comprising:

(a) an elongate backing element having a top end, a bottom end and at least one backing element clip capable of removably attaching the hand tool retaining device to a generally vertical elongate strap having a width between about ½ inch and about 4 inches;

(b) a base element disposed proximate to the bottom end of the backing element;

(c) an elongate guide element disposed along the backing element, the guide element having a first exterior side, an opposed second exterior side and an elongate slot which connects the first exterior side with the second exterior side, the slot having a top end, a bottom end, a width between about ½ inch and about 2 inches and an opening proximate to the top end of the slot for placing the neck of a hand tool within the slot, the opening in the guide element being provided by a wide portion in the elongate slot proximate to the upper end of the slot, the elongate slot further comprising a narrow portion proximate to the bottom end of the slot, the narrow portion being narrower than the wide portion, the guide element further comprising a stop disposed at the top end of the elongate slot, the guide element being disposed along the backing element such that a hand tool can be disposed against the backing element with the head of the hand tool resting upon the base element, with the handle of the hand tool disposed parallel to and contiguous with the backing element, with the neck portion of the head of the hand tool disposed within the elongate slot of the guide element, with the base portion disposed outside of the elongate slot along the first exterior side of the guide element and with the bulbous portion of the head disposed outside of the elongate slot along the second exterior side of the guide element; and (d) at least one head clip for removably retaining the head of a hand tool to the hand tool retaining device.

19. The hand tool retaining device of claim 18 wherein the elongate slot linearly increases in width from the bottom end of the slot to the top end of the slot by a total increase of between about ½ inch and about 1½ inch.

20. The hand tool retaining device of claim 18 wherein the backing element has a left side and a right side and wherein the guide element is removably attached to either the left side or the right side.

21. The hand tool retaining device of claim 1 further comprising retaining means for removably retaining the hand tool within the hand tool retaining device.

22. A hand tool retaining device for retaining a hand tool having a handle and a head, the retaining device comprising:

(a) an elongate backing element having a top end and a bottom end;

(b) a base element disposed proximate to the bottom end of the backing element, the base element comprising a head cover removably attached to the elongate backing element by attachment means requiring the use of no tools;

(c) an elongate guide element disposed along the backing element, the guide element having an elongate slot, the slot having a top end, a bottom end, a width between about ½ inch and about 2 inches and an opening proximate to the top end of the slot for placing the head of a hand tool within the slot, the guide element being disposed along the backing element such that a hand tool can be disposed against the backing element with the head of the hand tool resting upon the base element, with the handle of the hand tool disposed parallel to and contiguous with the backing element, and with the head of the hand tool disposed within the slot; and (d) retaining means for removably retaining the hand tool within the hand tool retaining device.

23. The hand tool retaining device of claim 22 wherein the head cover is attached to the backing element by hook and loop attachment.

24. A hand tool retaining device for retaining a hand tool having a handle and a head, the retaining device comprising:

(a) an elongate backing element having a top end and a bottom end;

(b) a base element disposed proximate to the bottom end of the backing element;

(c) an elongate guide element disposed along the backing element, the guide element being an elongate loop having an elongate slot, the slot having a top end, a bottom end, a width between about ½ inch and about 2 inches and an opening proximate to the top end of the slot for placing the head of a hand tool within the slot, the guide element being disposed along the backing element such that a hand tool can be disposed against the backing element with the head of the hand tool resting upon the base element, with the handle of the hand tool disposed parallel to and contiguous with the backing element, and with the head of the hand tool disposed within the slot; and (d) retaining means for removably retaining the hand tool within the hand tool retaining device.

25. A hand tool retaining device for retaining a hand tool having a handle and a head, the retaining device comprising:

(a) an elongate backing element having a top end and a bottom end;

(b) a base element disposed proximate to the bottom end of the backing element;

(c) an elongate guide element disposed along the backing element, the guide element having an elongate slot, the slot having a top end, a bottom end, a width between about ½ inch and about 2 inches and an opening proximate to the top end of the slot for placing the head of a hand tool within the slot, the elongate slot linearly increasing in width from the bottom end of the slot to the top end of the slot by a total increase of between about ½ inch and about 1½ inches, the guide element being disposed along the backing element such that a hand tool can be disposed against the backing element with the head of the hand tool resting upon the base element, with the handle of the hand tool disposed parallel to and contiguous with the backing element, and with the head of the hand tool disposed within the slot; and (d) retaining means for removably retaining the hand tool within the hand tool retaining device.

26. A hand tool retaining device for retaining a hand tool having a handle and a head, the retaining device comprising:

(a) an elongate backing element having a top end, a bottom end, a longitudinal axis, a left side, a right side and at least one pair of bores on its left and right sides, the bores being disposed in parallel with the longitudinal axis;

(b) a base element disposed proximate to the bottom end of the backing element;

(c) an elongate guide element disposed along the backing element, the guide element being an elongate loop having at least one end portion disposed within one of the two bores in the backing element, the guide element having an elongate slot, the slot having a top end, a bottom end, a width between about ½ inch and about 2 inches and an opening proximate to the top end of the slot for placing the head of a hand tool within the slot, the guide element being removably attached to either the left side or the right side of the base element, the guide element being disposed along the backing element such that a hand tool can be disposed against the backing element with the head of the hand tool resting upon the base element, with the handle of the hand tool disposed parallel to and contiguous with the backing element, and with the head of the hand tool disposed within the slot; and (d) retaining means for removably retaining the hand tool within the hand tool retaining device.

27. A hand tool retaining device for retaining a hand tool having a handle and a head, the retaining device comprising:

(a) an elongate backing element having a top end, a bottom end and at least two backing element bores disposed on the same side of the backing element;

(b) a base element disposed proximate to the bottom end of the backing element;

(c) an elongate guide element disposed along the backing element, the guide element being an elongate loop having at least one end portion disposed within one of the two bores in the backing element, the guide element having an elongate slot, the slot having a top end, a bottom end, a width between about ½ inch and about 2 inches and an opening proximate to the top end of the slot for placing the head of a hand tool within the slot, the guide element being removably attached to either the left side or the right side of the base element, the guide element being disposed along the backing element such that a hand tool can be disposed against the backing element with the head of the hand tool resting upon the base element, with the handle of the hand tool disposed parallel to and contiguous with the backing element, and with the head of the hand tool disposed within the slot; and (d) retaining means for removably retaining the hand tool within the hand tool retaining device.

28. A hand tool retaining device for retaining a hand tool having a handle and a head, the retaining device comprising:

(a) an elongate backing element having a top end, a bottom end and at least one backing element clip capable of removably attaching the hand tool retaining device to a generally vertical elongate strap having a width between about ¼ inch and about 4 inches;

(b) a base element disposed proximate to the bottom end of the backing element;

(c) an elongate guide element disposed along the backing element, the guide element having an elongate slot, the slot having a top end, a bottom end, a width between about ½ inch and about 2 inches and an opening proximate to the top end of the slot for placing the neck of a hand tool within the slot, the elongate slot linearly increasing in width from the bottom end of the slot to the top end of the slot by a total increase of between about ½ inch and about 1½ inches, the opening in the guide element being provided by a wide portion in the elongate slot proximate to the upper end of the slot, the elongate slot further comprising a narrow portion proximate to the bottom end of the slot, the narrow portion being narrower than the wide portion, the guide element further comprising a stop disposed at the top end of the elongate slot, the guide element being disposed along the backing element such that a hand tool can be disposed against the backing element with the head of the hand tool resting upon the base element, with the handle of the hand tool disposed parallel to and contiguous with the backing element, and with the neck of the head of the hand tool disposed within the slot; and (d) at least one head clip for removably retaining the head of a hand tool to the hand tool retaining device.

* * * * *